US007228778B2

(12) United States Patent
Edwards et al.

(10) Patent No.: US 7,228,778 B2
(45) Date of Patent: Jun. 12, 2007

(54) RECOIL REDUCTION ADAPTER

(76) Inventors: Terrell Edwards, 1041 Watermill La., Lexington, KY (US) 40505; Larry Henderson, 509 Texas School Rd., Eubank, KY (US) 42567

( * ) Notice: Subject to any disclaimer, the term of this patent is extended or adjusted under 35 U.S.C. 154(b) by 8 days.

(21) Appl. No.: 11/100,738

(22) Filed: Apr. 7, 2005

(65) Prior Publication Data

US 2006/0011056 A1 Jan. 19, 2006

Related U.S. Application Data

(60) Provisional application No. 60/560,063, filed on Apr. 7, 2004.

(51) Int. Cl.
*F41A 21/00* (2006.01)

(52) U.S. Cl. ..... 89/14.3; 42/1.06

(58) Field of Classification Search ..... 89/1.7, 89/1.701–1.706, 14.3; 42/1.06; D22/108
See application file for complete search history.

(56) References Cited

U.S. PATENT DOCUMENTS 1,450,558 A * 4/1923 Maze ..... 89/1.1
2,206,567 A * 7/1940 Hughes ..... 89/14.3
2,420,492 A * 5/1947 Marseilles ..... 89/14.3
3,628,415 A * 12/1971 McElroy ..... 89/14.05
4,126,077 A * 11/1978 Quesnel ..... 89/1.704
D281,895 S * 12/1985 McLain ..... D22/108
D285,238 S * 8/1986 Cellini ..... D22/108
4,813,333 A * 3/1989 Garris et al. ..... 89/14.3
5,844,162 A * 12/1998 Renner ..... 89/14.3
6,578,462 B1 * 6/2003 Franchino et al. ..... 89/14.3

* cited by examiner

*Primary Examiner*—Michael J. Carone
*Assistant Examiner*—Bret Hayes
(74) *Attorney, Agent, or Firm*—Ober/Kaler; Royal W. Craig

(57) ABSTRACT

A pneumatic recoil reduction adapter for use with a barrel and breech of an existing explosives disarmer. The adapter substantially reduces and, indeed, achieves near-total recoil reduction of recoil using venturi-venting rather than damping liquids, spring-damped shot tubes or other unwieldy mechanics. The recoil reduction adapter is formed with a central chamber to seat a cartridge and a plurality of axially extending passages leading outward from the central chamber through a corresponding plurality of radially-spaced venturi nozzles. Upon firing, exhaust gases are vented rearwardly back through the central chamber and outward through the venturi nozzles to offset and thereby reduce recoil forces.

10 Claims, 9 Drawing Sheets

RECOIL REDUCTION ADAPTER

CROSS-REFERENCE TO RELATED APPLICATIONS

The present application derives priority from U.S. provisional application Ser. No. 60/560,063 filed 7 Apr. 2004.

BACKGROUND OF THE INVENTION

1. Field of the Invention

The present invention relates to explosives disruptors for remote disruption of explosive devices such as pipe bombs, letter bombs, hand grenades, land mines, etc., and, more particularly, to a new recoil reduction adapter attachable between barrel and breech of a conventional explosives disruptor for venturi-venting of combustion gases in order to substantially eliminate recoil which might otherwise endanger people or equipment in the vicinity of the disrupter.

2. Description of the Background

Emergency service personnel responsible for explosive device disposal are often called upon to render explosive devices safe, such as pipe bombs, letter bombs, hand grenades, land mines, etc. The task of disarming such devices is often accomplished by a robot carrying some form of de-arming device or remote disruption. FIG. 1A is a perspective photo of a robotic disposal unit carrying a forwardly-wielded robotic arm as well as a prior art explosives disruptor 2 for firing a projectile.

Bomb squads typically use a variety of disruptors, which are shotgun-like tubes capable of shooting air, water, shot or slugs at the target. These are used to incapacitate many types of explosives, and are particularly effective in removing the ends of pipe bombs.

By way of example, Cherry, U.S. Pat. No. 4,957,027 discloses a multi-barrel de-armer that requires a shock tube to fire a small arms cartridge into an explosive device.

Heller, U.S. Pat. No. 5,210,368 discloses a tripod-mounted, electrically activated de-armer that fires a shotgun shell at an explosive device.

Gilbert, U.S. Pat. No. 5,515,767 discloses a recoil-absorbing de-armer which fires a projectile from a barrel by means of an explosive charge placed behind the projectile.

The most typical explosives disrupters operate by firing a solid projectile or water at an explosive device so as to disrupt the fuse mechanism of the explosive device, ideally without detonating the explosive device. These explosives disrupters comprise a barrel with attached breech, the barrel containing an explosive (shotgun shell) charge which, when initiated, propels shot towards the target. Although these explosives disrupters are operated by remote control, problems can still arise from the mechanical reaction caused by firing the projectile(s). The barrel can recoil with a momentum sufficient to endanger people or equipment in the vicinity of the disrupter.

Consequently, for any explosives disrupter that fires a shotgun shell at an explosive device, there is a need for improved recoil reduction.

In this regard, U.S. Pat. No. 6,644,166 to Alexander et al. issued Nov. 11, 2003, shows an explosives disrupter with a flexible, recoil-absorbing system for minimizing the effects of recoil on the accuracy of the device.

U.S. Pat. No. 5,515,767 to Gilbert issued May 14, 1996 shows a de-arming device with a sleeve surrounding the barrel, so as to define an annular chamber accommodating solid or liquid recoil absorbing material. Radial ports interconnect the barrel and the annular chamber so that when the projectile is fired the annular chamber is pressurized and the recoil absorbing material is expelled rearward from the chamber, so as to counteract recoil.

In both of the foregoing devices the recoil reduction is accomplished with fairly complex equipment and liquids. Due to their level of complexity, these recoil reduction mechanisms are an integral part of the disrupter and cannot be retrofit to an existing disrupter. Moreover, such complex hydraulics, springs, shock absorbers, etc., are expensive, difficult to use, and of such modest effectiveness (50–70% reduction in recoil) that emergency squads that buy them eventually wind up not using them.

It would be far more advantageous to provide a pneumatic recoil reduction adapter that is simple in design, inexpensive to manufacture, convenient to use, that can be retrofit to any disrupter, and which yields an 80–90% reduction in recoil.

For purposes of illustration, FIG. 1B is a perspective side photo of a prior art disrupter 2 without recoil reduction. The disrupter 2 generally includes a disrupter barrel 10 coupled to a breech portion 30. The disrupter barrel 10 is an elongate rod having a coupling at one end, preferably a screw coupling, for attachment to breech portion 30. Internally, the disrupter barrel is open at the loading end where it attaches to breech portion 30 for insertion of a shot cartridge, and has a smooth bore throughout for ejecting the shot. Barrel 10 may be any commercially available projectile-firing disrupter, such as a PAN (Percussion Actuated Non-electric) disrupter, distributed by Ideal Products, Lexington, Ky. under the trademark PAN DISRUPTER™. Typically, the midsection of disrupter barrel 10 is attached to a support frame or robotic device (as in FIG. 1). The breech portion 30 is a machined component formed with a coupling at one end, such as internal screw-threads, for screw-insertion onto the disrupter barrel 10. There are a variety of commercially-available breeches most often sold in combination with a particular disrupter barrel 10, such as the PAN disrupter identified above (this breech is also shown in the Cherry '027 patent). In operation, the breech 30 is unscrewed from the disrupter barrel 10, and a cartridge such as a standard or modified shotgun shell is inserted into the loading end of the barrel 10. The breech 30 is then screwed back onto disrupter barrel 10. The breech portion 30 includes a firing mechanism for firing the cartridge (not shown), which is typically activated by coupling a pneumatic system (known as a "shock tube" to nipple 37. A blast of air through the shock tube drives the firing mechanism into the cartridge, which is then propelled the entire length of the barrel 10.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a pneumatic recoil reduction adapter 20 for use in damping the recoil of a firearm system. The present adapter 20 substantially reduces and, indeed, achieves near-total recoil reduction using venturi-venting rather than damping liquids, spring-damped shot tubes or other unwieldy mechanics. While designed specifically for use with an existing explosives disrupter as shown in FIG. 1B, one skilled in the art will understand that the adapter may be used for recoil reduction of virtually any firearm barrel with only minor modification.

Figure 1A:
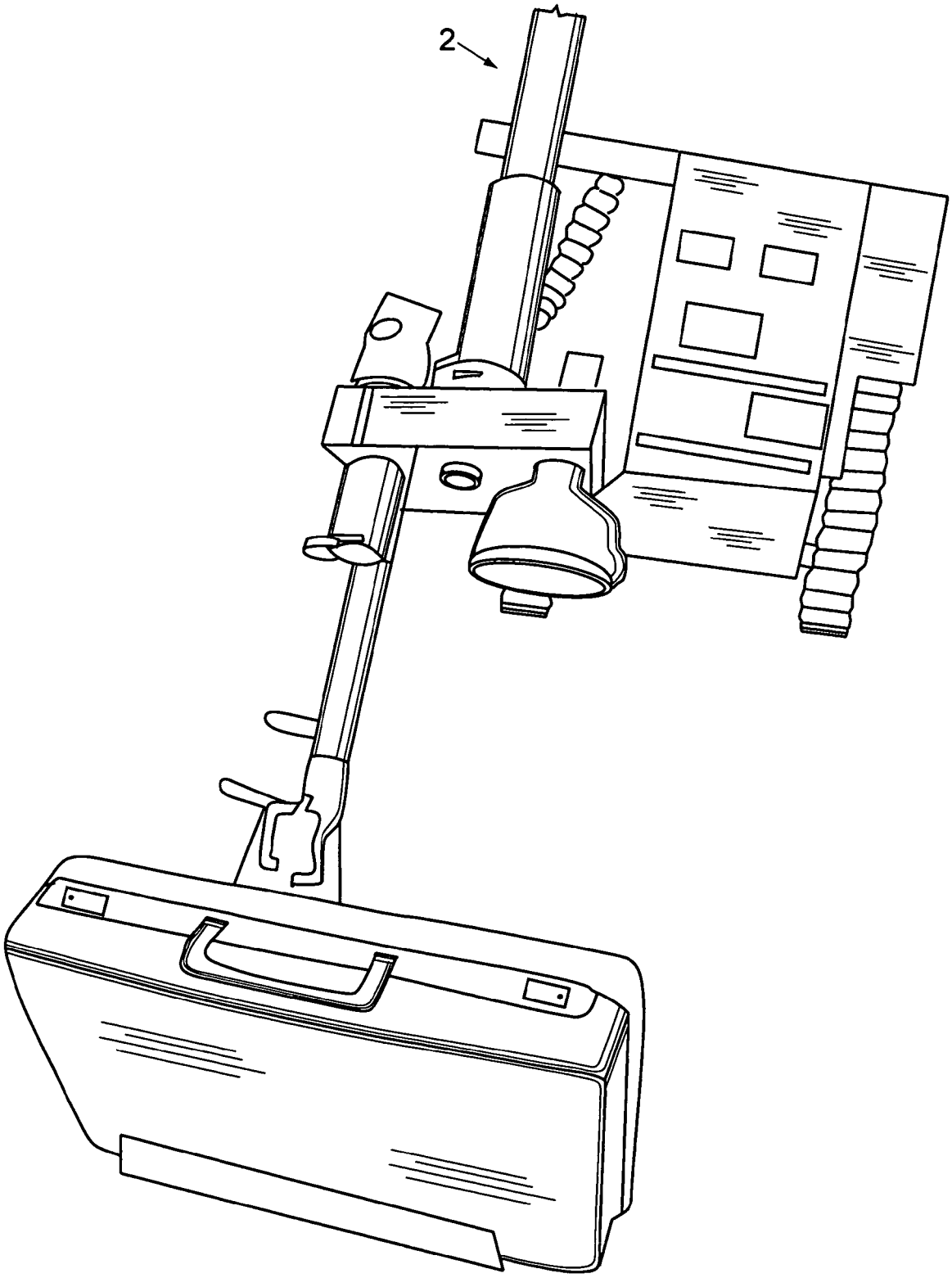
FIG. 1A is a perspective photo of a robotic disposal unit carrying a prior art explosives disruptor.
Figure 1B:
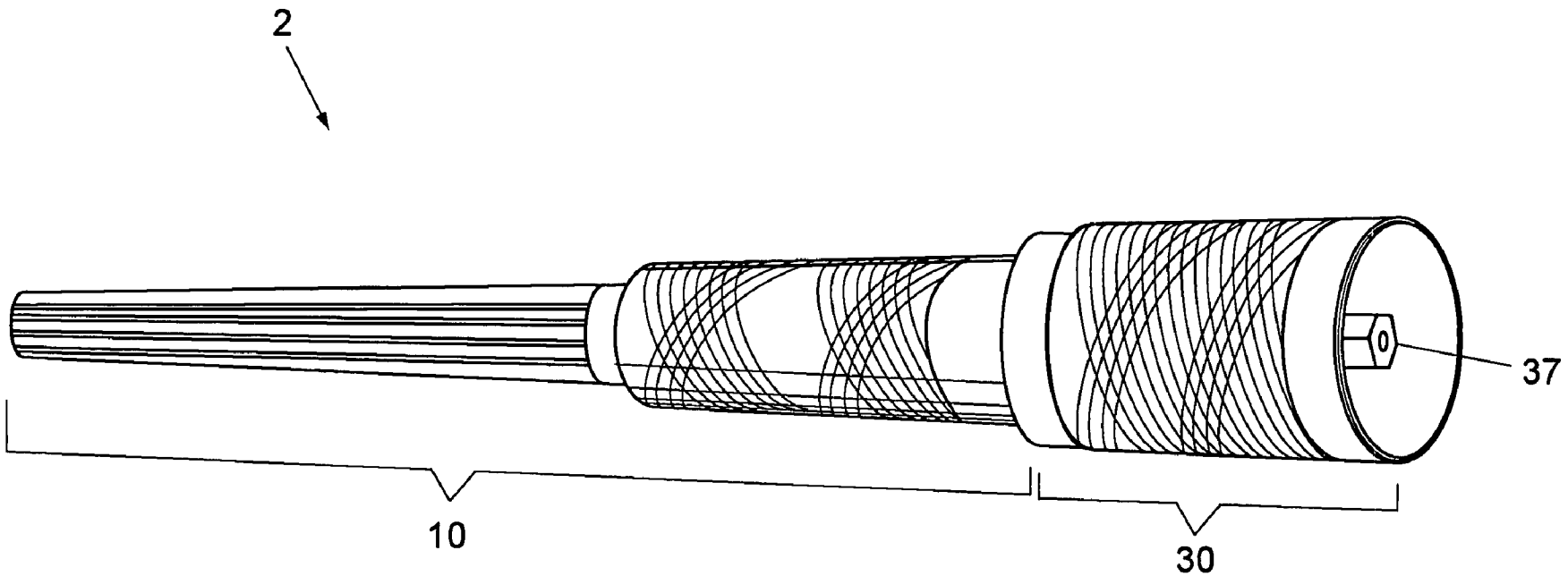
FIG. 1B is a side perspective view of a prior art disrupter 2 including a disrupter barrel 10 coupled to a breech portion 30.
Figure 2:
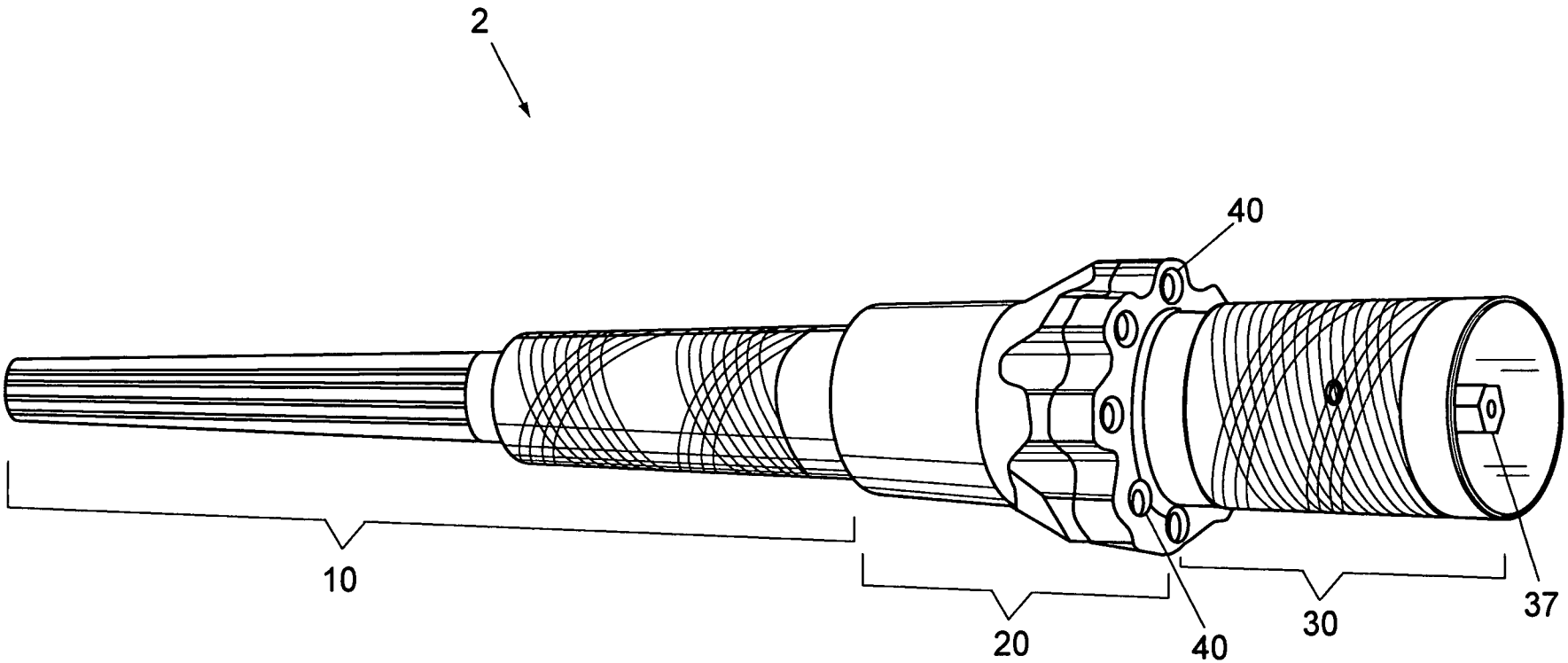
FIG. 2 is a perspective photo of the recoil reduction adapter 20 according to the present invention which is coupled between disrupter barrel 10 and breech portion 30 of FIG. 1.

FIG. 2 is a perspective photo of the recoil reduction adapter 20 according to the present invention shown coupled between disrupter barrel 10 and breech portion 30 of FIG. 1. As described previously, conventional barrels 10 are typically designed to dock with conventional breech portions 30 when recoil reduction is unnecessary, and the two components are therefore formed with a coupling (such as, for example, a male-female screw-threaded coupling). Thus, in FIG. 2 the breech portion 30 is formed with internal screw-threads 21 which can be screwed directly onto the external threads of the barrel 10 (see FIG. 4). A conventional shot cartridge is inserted into the loading end of the barrel 10 (the cap of the shot cartridge seats in an annular recess), and all exhaust gases from firing are exhausted directly forward and out the end of the barrel 10.

The recoil reduction adapter 20 according to the present invention intercedes the barrel and breech 30 and is thereby formed with conforming couplings at both ends. When recoil reduction is necessary, the adapter 20 is screwed into one end of the disrupter barrel 10. The shot cartridge is inserted into the adapter 20 rather than the barrel 10, and the breech portion 30 is screwed onto the adapter 20 at the other end. The adapter 20 causes the exhaust gases from firing to be vented rearwardly from the barrel 10 into the adapter 20 and outward therefrom through a series of radially-spaced venturi nozzles 40.

Figure 3:
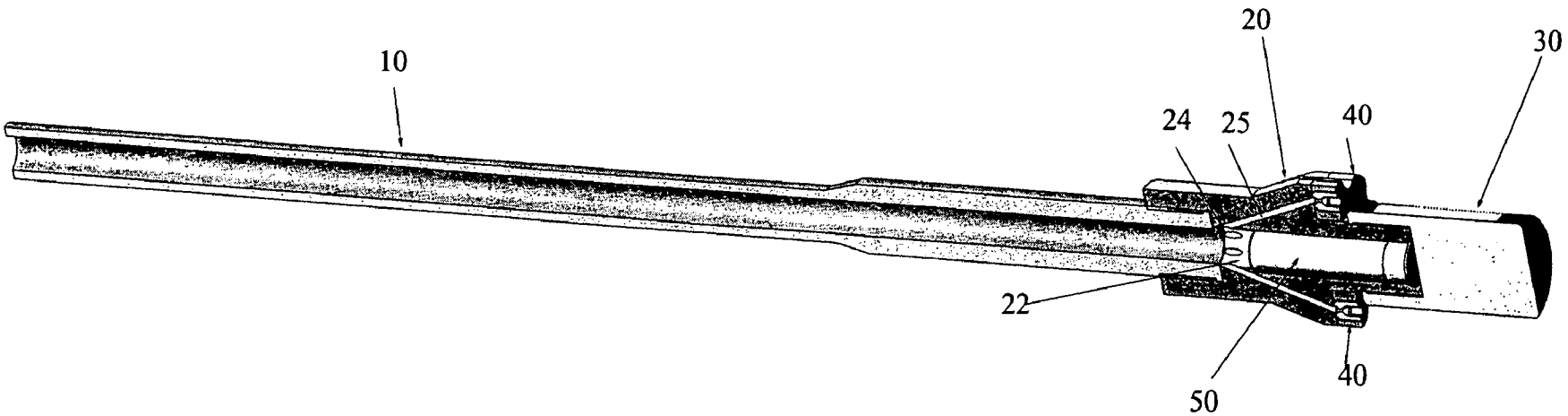
FIG. 3 is side cut-away perspective view of the disrupter barrel 10, adapter 20, and breech portion 30 as in FIG. 2.

FIG. 3 is side cut-away perspective view of the disrupter barrel 10, adapter 20, and breech portion 30 as in FIG. 2 with a cartridge 50 seated in the adapter 20. The adapter 20 is formed with a through-bore central chamber that is sized for slidable insertion of a standard 12-gauge shotgun shell, although the dimensions may easily be varied to seat any of the many other disrupter cartridges available. Just like the existing barrel 10, the chamber of adapter 20 is preferably journalled to seat the protruding flange of the cap of cartridge 50. An exhaust chamber 22 lies in advance of the cartridge 50, and a plurality of radial ports 24 open from the exhaust chamber 22, each port 24 leading rearward and outward through a channel 25 to a venturi nozzle 40 outlet.

In accordance with the present invention, as the projectile shot is being fired from the cartridge 50, the combustion gases from the cartridge 50 are vented out through the recoil reduction adapter 20 as will be described to reduce and substantially eliminate recoil.

Figure 4:
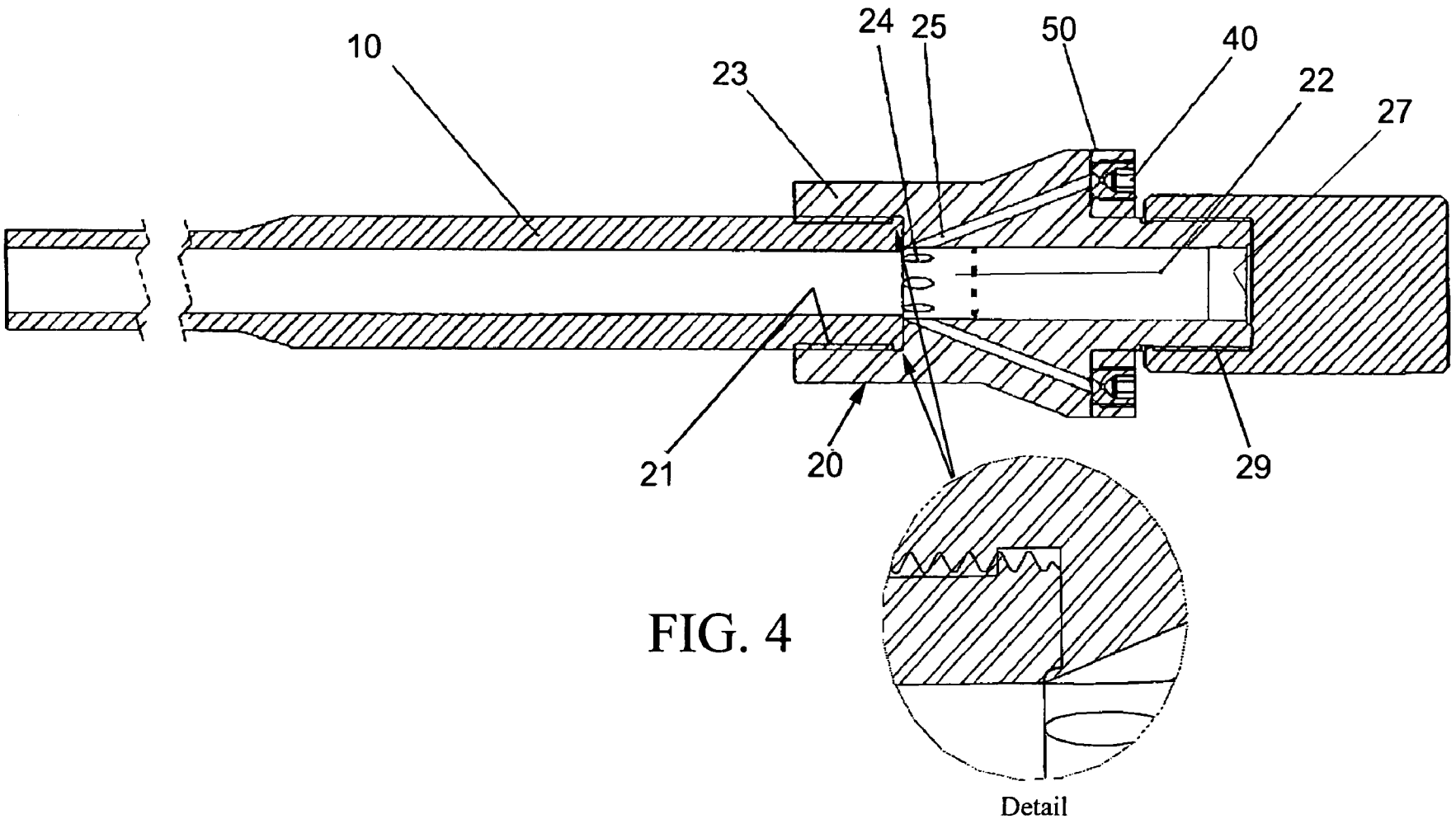
FIG. 4 is a side cut-away view of the disrupter barrel 10, adapter 20, and breech portion as in FIGS. 2–3.

FIG. 4 is a side cut-away view of the disrupter barrel 10, adapter 20, and breech portion 30 as in FIGS. 2–3, with a detail illustration of the junction of the barrel 10 and adapter 20. The recoil reduction adapter 20 is an annular component which includes an adapter body 23 that may be machined from a unitary blank of stainless steel. Adapter body 23 is formed with two end-couplings, for example, a male externally-screw-threaded coupling end 29 for screw insertion into breech 30, and a female internally-screw-threaded coupling end 21 for screw insertion of barrel 10. Adapter 20 is formed with a central cartridge chamber running entirely there through between the coupling ends 21, 29, and the chamber is journalled at coupling end 29 to define an annular cartridge seat 27 for seating the protruding flange of the brass cap of cartridge 50. When a cartridge is seated in the chamber, an area of space known as the exhaust chamber 22 is left in advance of the cartridge (in front of the dotted line). The radial ports 24 open from the exhaust chamber 22 toward coupling end 21, and each port 24 leads rearward and outward through a channel 25 to a venturi nozzle 40 outlet. The venturi nozzle 40 outlets are rearwardly-oriented and spaced radially around the adapter body 23 and directed outward over the breech 30 at the junction of the coupling end 29. The venturi nozzles 40 are preferably removably/replacably held in the adapter body 23 as will be described.

Figure 5:
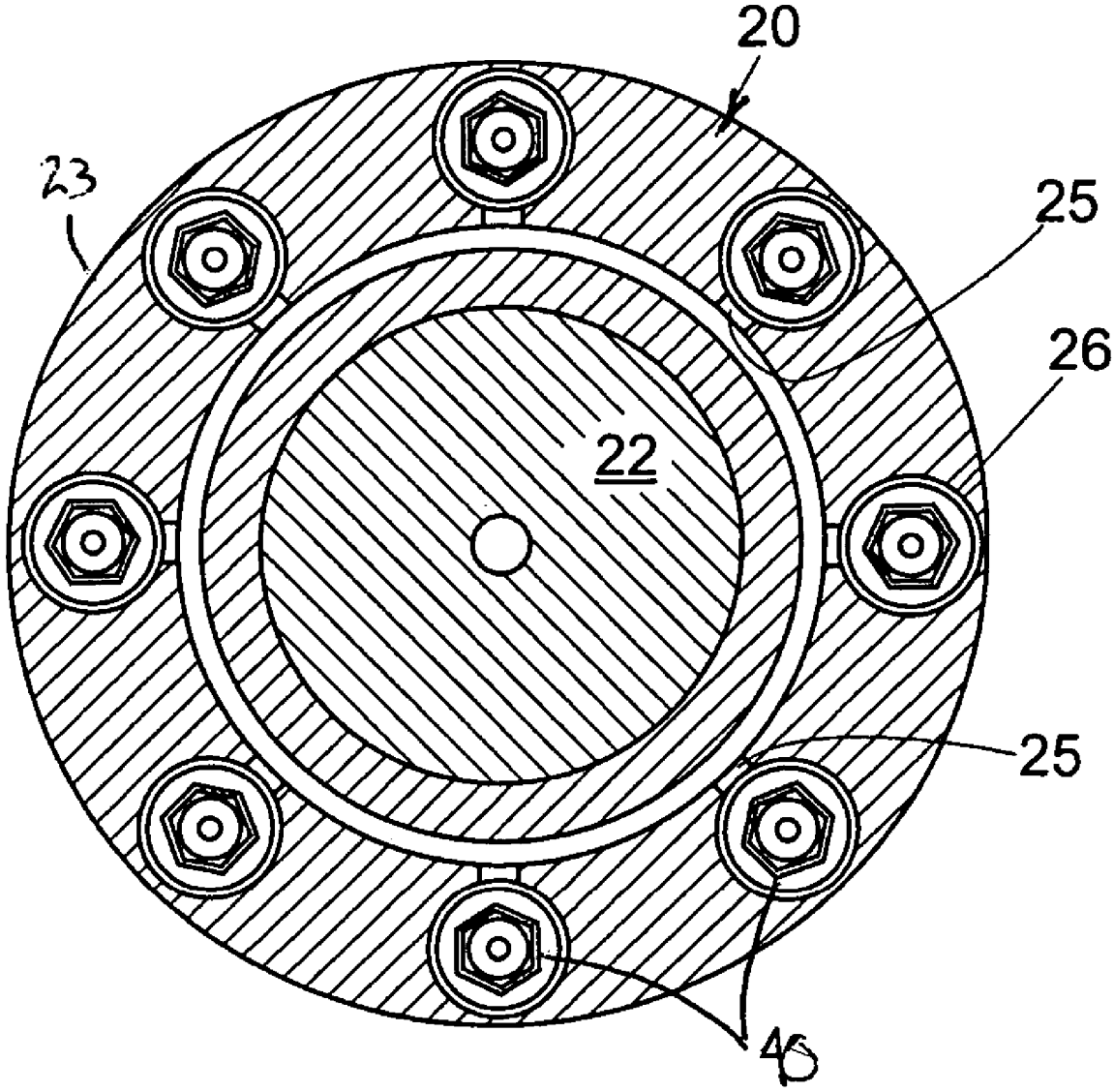
FIG. 5 is a front view of the breech portion 30 of FIG. 1 with recoil reduction adapter 20 installed.

FIG. 5 is a front view of the recoil reduction adapter 20 showing eight radially-spaced venturi outputs 40; each output 40 pointing rearward from the adapter body 23 out over the breech 30. Of course, the adapter body may be formed with more or fewer channels and venturi outputs 40 as desired, as a matter of design choice.

Figure 6:
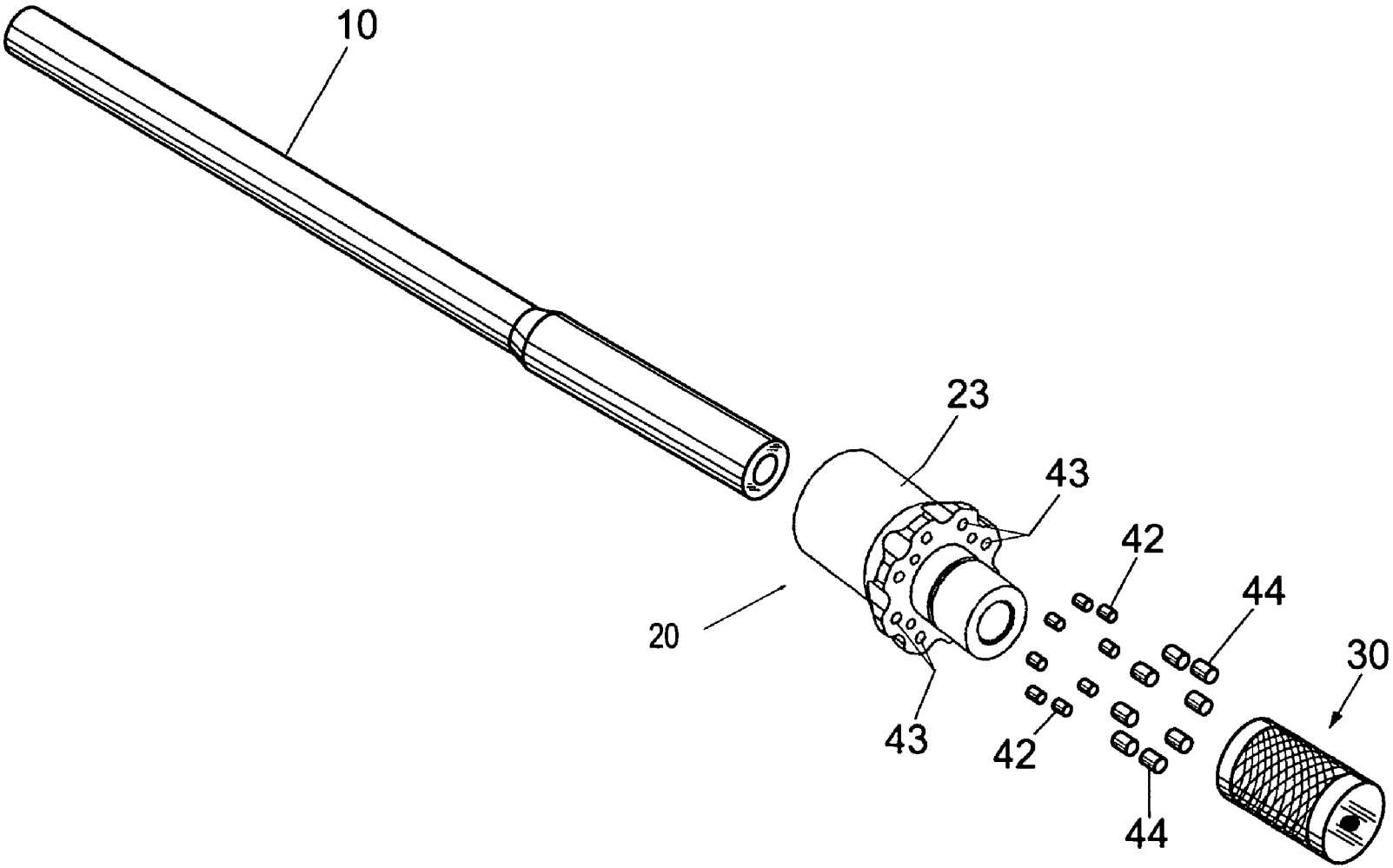
FIG. 6 is an exploded perspective view of the recoil reduction adapter 20.

FIG. 6 is an exploded perspective view of the recoil reduction adapter 20 illustrating one exemplary means by which the venturi outputs 40 may be implemented. The adapter body 23 is formed with screw-threaded receptacles 43 into which discrete venturi nozzles 42 are inserted. The venturi nozzles 42 are then held in place by retaining collars 44. The retaining collars 44 are simply threaded bushings that screw into outlets 40 subsequent to venturi nozzles 42 to keep them captive therein. Of course, the venturi nozzles 42 themselves may be screw threaded for self-securement in receptacles 43, thereby avoiding the need for retaining collars 44. Each venture nozzle 42 is a nozzle with constricted orifice for accelerating airflow, as detailed below.

Figure 7:
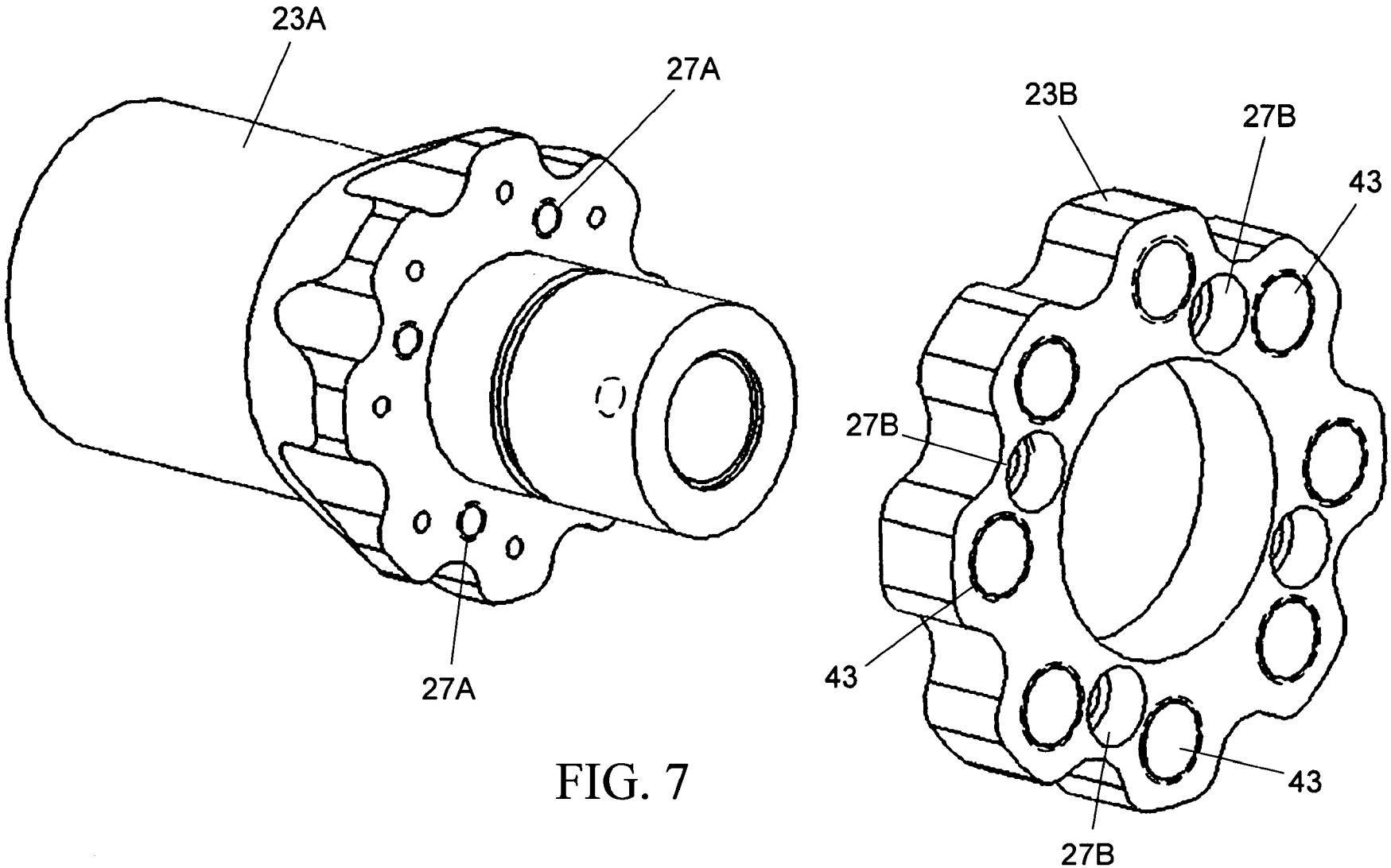
FIG. 7 illustrates a preferred two-piece adapter body which simplifies machining.

FIG. 7 illustrates a preferred two-piece adapter body which simplifies machining. The adapter body is formed similar to that of FIG. 6 except that the venturi nozzles 42 and retaining collars 44 are inserted into a ring 23B, which is then secured to an adapter body primary component 23A. In this case ring 23B is formed with screw-threaded receptacles 43 into which the discrete venturi nozzles 42 are inserted. The venturi nozzles 42 may again held in place by retaining collars 44 or themselves may be screw threaded. Ring 23B is also formed with a series of set screw holes 27B (four are shown), and adapter body primary component 23A is formed with a corresponding plurality of set screw holes 27A, thereby allowing the two-piece adapter body to be secured together by set screws.

Figure 8:
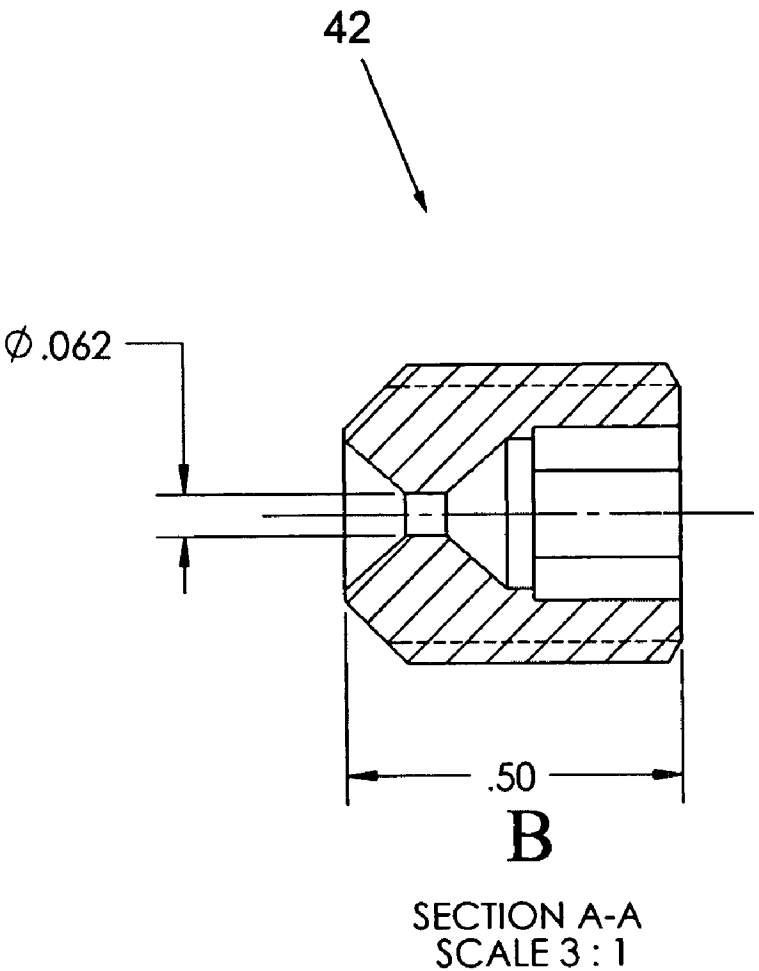
FIG. 8 is a composite drawing showing the configuration and dimensions of the presently preferred venturi nozzles 42 as used in FIGS. 2–7
Figure 8:
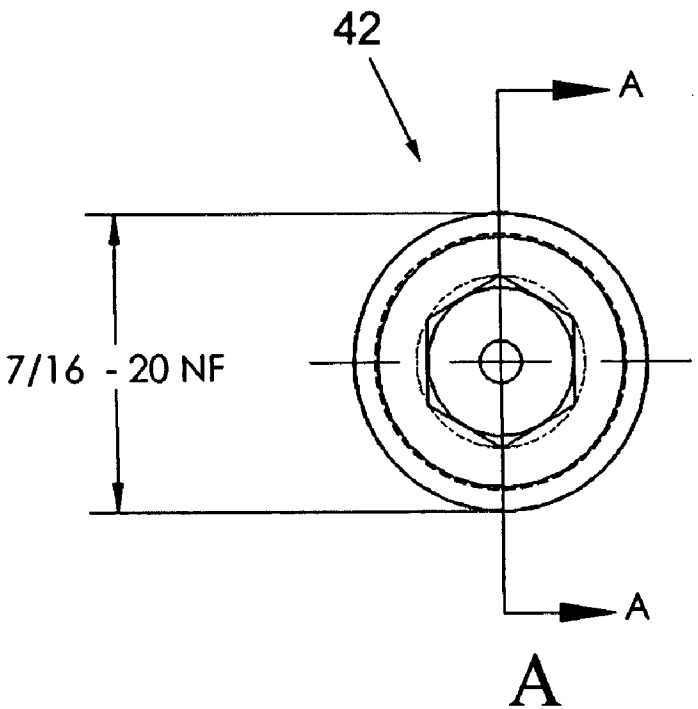

FIG. 8 is a composite drawing showing the configuration and dimensions of the presently preferred venturi nozzles 42 as used in FIGS. 2–7 (front view at position A and side cross-section at position B). The venturi nozzles 42 are air-jet vacuum ejectors comprising a constricted gas orifice of approximately 0.062 mm, which is calibrated to maintain a pressure differential between the input and discharge pressure.

In operation of all the foregoing embodiments, when the overall device 2 is to be fired, it is set up by a bomb technician at a distance from the target to be de-armed. A 12-gauge shotgun cartridge is loaded into the adapter 20. The cartridge is then remotely initiated, using the firing mechanism in breech 30. This propels the projectile shot out of the adapter 20 and barrel 10. Rather than spewing all the combustion gases forward, a percentage of the propellant gas is exhausted to the rear of the device 2, where it is vented outward through the venturi nozzles 42. The venturi nozzles 42 have a constricted orifice that increases the gas velocity and so reduces the recoil generated by the projectile. More specifically, expanding combustion gases produced by the detonation of the cartridge pass through the exhaust chamber 22 of recoil reduction adapter 20, and outward through channels 25, venturi nozzles 42, and outlets 40. The impact of the recoil is cushioned by the venturi nozzles 42 which attempt to maintain a constant pressure differential despite the expanding gases produced by the detonation of the cartridge. The radial array of venturi nozzles 42 means that the force countering the recoil is symmetrical and balanced. The device is also simple, lightweight, and quick to re-load for a subsequent firing.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. An apparatus for use in damping the recoil of a disrupter firearm system, comprising a recoil reduction adapter attachable between a disrupter barrel and breech portion, said recoil reduction adaptor comprising a chamber in communication with said barrel for seating a shot cartridge, and a plurality of vent passages leading rearwardly from said chamber and exiting said recoil reduction adapter through a corresponding plurality of venturi nozzles; whereby exhaust gases from said cartridge are expelled from the recoil reduction adapter through said venturi nozzles to reduce recoil, wherein the chamber of said recoil reduction adapter is journalled at its breech end to define an annular cartridge seat to seat a protruding flange of a shot cartridge.

2. The apparatus for use in damping the recoil of a disrupter firearm system according to claim 1, wherein the chamber of said recoil reduction adapter is dimensioned to leave an unoccupied exhaust chamber in advance of said shot cartridge when seated in said cartridge seat.

3. The apparatus for use in damping the recoil of a disrupter firearm system according to claim 2, wherein said exhaust chamber is defined by a plurality of radial ports.

4. The apparatus for use in damping the recoil of a disrupter firearm system according to claim 3, wherein said vent passages lead outward from said radial ports.

5. The apparatus for use in damping the recoil of a disrupter firearm system according to claim 3, wherein said vent passages lead outward from said radial ports and away from said barrel.

6. A device for firing a projectile, the device comprising a barrel portion for expelling said projectile, a breech portion containing a firing mechanism for said projectile, and a recoil reduction adapter coupled at one end to said barrel portion and at another end to said breech portion, said adapter being formed with a central chamber defining a recess for seating a cartridge and an exhaust chamber in advance of said cartridge, and a plurality of axially extending passages leading from said exhaust chamber outward from said adapter and rearward therefrom opposite said barrel portion to vent exhaust gasses in a direction offsetting recoil forces from firing said projectile, wherein the chamber of said recoil reduction adapter is journalled at its breech end to define an annular cartridge seat to seat a protruding flange of a shot cartridge.

7. A device for firing a projectile according to claim 6, wherein the chamber of said recoil reduction adapter is dimensioned to leave an unoccupied exhaust chamber in advance of said shot cartridge when seated in said cartridge seat.

8. A device for firing a projectile according to claim 7, wherein said exhaust chamber is defined by a plurality of radial ports.

9. The device for firing a projectile according to claim 8, wherein said vent passages lead outward from said radial ports and away from said barrel portion.

10. A device for firing a projectile according to claim 9, wherein each of said venturi nozzles is defined by a constricted orifice to increase exhaust gas velocity and thereby offset recoil generated by the shot cartridge.

* * * * *